US005248362A

United States Patent [19]

Sissons

[11] Patent Number: 5,248,362

[45] Date of Patent: Sep. 28, 1993

[54] METHOD FOR APPLYING GLUE TO THE FLUTE TIPS OF A SINGLE-FACED CORRUGATED PAPERBOARD SHEET

[75] Inventor: Anthony J. Sissons, Gastonia, N.C.

[73] Assignee: Interfic Developments, Inc., Gastonia, N.C.

[21] Appl. No.: 901,799

[22] Filed: Jun. 22, 1992

Related U.S. Application Data

[62] Division of Ser. No. 705,327, May 24, 1991, Pat. No. 5,129,980.

[51] Int. Cl.[5] ..... B31F 1/28; B05D 1/28

[52] U.S. Cl. ..... 156/205; 156/210; 156/470; 156/578; 427/428

[58] Field of Search ..... 156/470, 578, 583.91, 156/205, 210; 118/248, 253; 427/428

[56] References Cited

U.S. PATENT DOCUMENTS

| | | | |
|---|---|---|---|
| 998,221 | 7/1911 | Wheeler | 118/248 |
| 1,053,297 | 2/1913 | Kehrhahn | 118/248 |
| 1,835,816 | 12/1931 | Sieg . | |
| 2,120,533 | 6/1938 | Tillson . | |
| 2,499,267 | 2/1950 | Conner . | |
| 3,289,906 | 12/1966 | Schuller . | |
| 3,336,900 | 8/1967 | Hitt | 118/248 |
| 3,951,725 | 4/1976 | Bradley, Jr. et al. | 156/473 |
| 4,316,755 | 2/1982 | Flaum et al. | 156/205 |
| 4,617,076 | 10/1986 | Jones, Jr. et al. | 156/205 |
| 4,655,163 | 4/1987 | Hokenson . | |
| 4,764,236 | 8/1988 | Nikkel | 156/205 |

OTHER PUBLICATIONS

Brochure for DGY—300 Eagle Double Glue Unit, by United Container Machinery Group Inc.

Brochure for Hokenson Glue Machines, by Hokenson Enterprises, Inc.

*Primary Examiner*—Michael W. Ball

*Assistant Examiner*—Michele K. Yoder

*Attorney, Agent, or Firm*—Bell, Seltzer, Park & Gibson

[57] ABSTRACT

A contact bar for slidably contacting the liner of a single-faced corrugated paperboard sheet to press the flute tips of the sheet against a rotating glue roll without crushing the flute tips. The contact bar includes an elongate frame mounted opposite and in spaced-apart relation from the rotating glue roll. A series of shoes are pivotally connected to the frame and depend therefrom defining a predetermined clearance from the outer surface of the rotating glue roll. The shoes are biased by springs to cause the shoes to slidably contact the liner and press the flute tips against the rotating glue roll. The shoes may be formed of cold-rolled steel providing a reasonably long expected service life and also having an abrasion resistance so that conformance of the shoe contact surfaces with the rotating glue roll and a single-faced sheet occurs in a relatively short time caused by abrasion with the slidably contacting single-faced sheet.

4 Claims, 2 Drawing Sheets

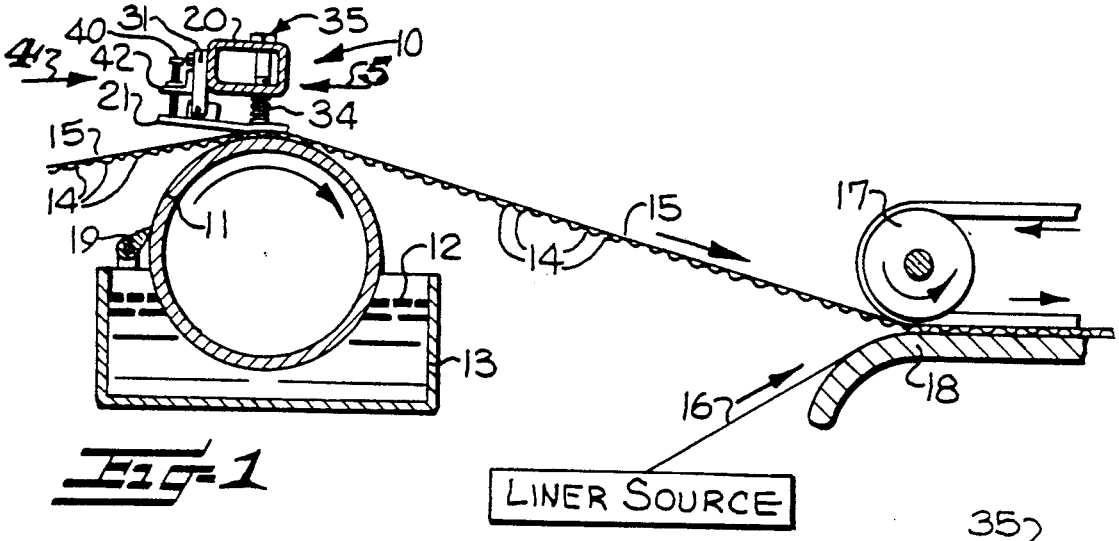
Fig-1
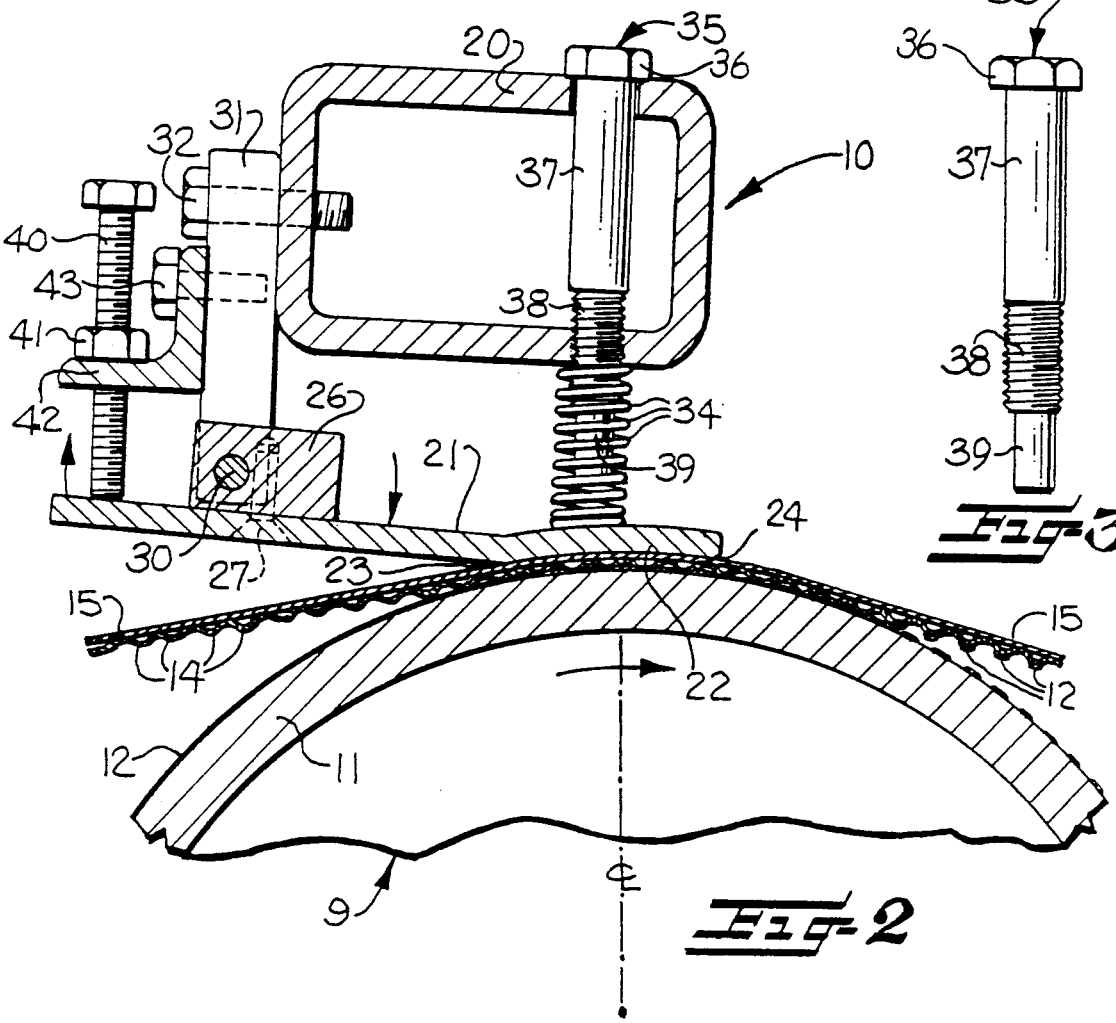
Fig-2
Fig-3

METHOD FOR APPLYING GLUE TO THE FLUTE TIPS OF A SINGLE-FACED CORRUGATED PAPERBOARD SHEET

This application is a division of application Ser. No. 07/705,327, filed May 24, 1991 now U.S. Pat. No. 5,129,980.

FIELD OF THE INVENTION

This invention relates to the field of corrugated paperboard manufacturing, and more particularly, to a contact bar for pressing the flute tips of a sheet of single-faced corrugated paperboard into contact with a glue application roll.

BACKGROUND OF THE INVENTION

Corrugated paperboard is used extensively for packaging goods and protecting them during storage and shipping. A corrugated paperboard manufacturing process typically starts with a single sheet of paper commonly referred to as a liner. To this liner is added a fluted medium, by the use of an adhesive, thereby forming a single-faced sheet of corrugated paperboard. Positive pressure may be used to press the fluted medium into intimate contact with the liner. Thus, there is little concern for crushing the flute tips or failing to achieve sufficient contact between the fluted medium and the liner so that glue is omitted from a flute line.

A second opposing liner must be adhesively applied to the flute tips of the single-faced corrugated sheet to form the double-faced corrugated paperboard. Typical corrugating machines apply adhesive to the flute tips by a rotating glue applicator roll and an opposing backing, or pressure, roll. The glue applicator roll turns at about the speed of the single-faced sheet, while the lower portion of the rotating roll picks up glue from a suitable reservoir. Glue is thus transferred from the rotating glue roll to the flute tips of the single-faced sheet. After the glue is applied to the flute tips, the second liner is brought into contact with the flute tips to form the double-faced corrugated paperboard as is typically used in corrugated packaging containers.

To ensure that the flute tips adequately contact the glue roll so that glue is applied to all of the flute tips of the single-faced sheet, pressure must be applied to the back, or liner side, of the single- o faced sheet. It is known in the art to use a rotating pressure roll positioned opposite the glue roll to ensure contact between the flute tips of the single- o faced sheet and the glue roll. For example, U.S. Pat. No. 4,316,755 to Flaum et al. discloses a typical rotating pressure roll positioned opposite the glue applicator roll.

Unfortunately, the opposing pressure roll of the prior art may frequently cause crushing of the flute tips as the single-faced sheet is pinched at the tangent point between the pressure roll and the glue roll. This is especially true as more recycled materials are used in the manufacturing of corrugated paperboard. The recycled materials typically have shorter fibers which make the flute tips formed of these shorter fibers more susceptible to crushing if the proper amount of pressure is not applied.

The U.S. Interstate Commerce Commission has recently removed certain regulatory restrictions requiring specific weights of paper to be used in corrugated paperboard manufacturing. Accordingly, many manufacturers are likely to vary the weight of the liners and the fluted medium in an effort to reduce cost while still producing a commercially viable product. Lessening the weight of the fluted medium, for example, is likely to further exacerbate the problem of crushing of the flute tips of the single-faced sheet caused by a rotating pressure roll.

It is also known in the art to provide an air bearing in place of the pressure roll to attempt to overcome crushing of the flute tips and other limitations associated with the rotating pressure roll. For example, U.S. Pat. No. 4,655,163 to Hokenson discloses an air bearing for pressing the single-faced sheet against the glue roll using an air pressure of about a half to a few psi above atmospheric pressure. The purpose for the air bearing disclosed in Hokenson is to cause the flute tips to lightly touch the glue roll to prevent "washboarding" from too much glue applied to the tips. The Hokenson air bearing has a plurality of air outlets supplied along its length and positioned opposite the rotating glue roll.

U.S. Pat. No. 4,617,076 to Jones, Jr. et al. similarly discloses an air bearing for providing contact of the flute tips with the rotating glue roll and having the stated purpose of preventing crushing of the flute tips. Similarly, U.S. Pat. No. 4,764,236 to Nikkel discloses an air bearing having a plurality of segmented shoes resiliently secured to a common manifold air source by springs. Nikkel discloses air bearing shoes of different widths on the outer and inner portions of the air bearing, thereby necessitating a larger inventory of spare parts for maintenance.

The air bearings typically have relatively complicated structures including air passageways, manifolds, and require a source of pressurized air. Small air passageways may readily clog in the presence of glue as used for corrugated paperboard manufacturing. In addition, the air bearing may spray glue throughout the machine if the air outlets of the air bearing are not completely covered by the single-faced sheet. Air bearings may also not provide sufficient protection against crushing of the flute tips, especially in light of the use of more recycled materials or in the case of a reduced weight fluted medium.

Thus, although the difficulty of pressing the single-faced sheet against an opposing glue roll without crushing the flute tips is recognized in the art, a simple, yet reliable, apparatus has not heretofore been developed for ensuring proper contact between the single-faced corrugated paperboard sheet and the rotating glue roll without crushing the flute tips of the sheet.

SUMMARY OF THE INVENTION

It is therefore an object of the present invention to provide an apparatus for ensuring proper contact between the flute tips of a single-faced corrugated paperboard sheet and a rotating glue roll so that the flute tips receive the proper quantity of glue without being crushed.

It is a further object of the present invention to provide a device for ensuring proper contact between the flute tips of a single-faced corrugated sheet and a rotating glue roll which has a relatively simple construction and which is easy to install and maintain.

These and other objects are provided by the present invention which is used, in combination with a rotating glue roll, for applying glue to the flute tips of a single-faced corrugated paperboard sheet. The glue roll is conventional and is typically partially immersed in a glue contained within a suitable reservoir. Means may also be provided for metering the quantity of glue picked up by the rotating roll on each revolution through the glue.

The invention is a contact bar for mounting in a corrugated paperboard manufacturing machine. The contact bar includes a frame and a series of side-by-side contact shoes connected thereto. The frame may preferably include an elongate tubular member positioned opposite the rotating glue roll and extending along substantially the entire length of the glue roll. The contact shoes are preferably pivotally mounted depending from the frame. The shoes include a contact surface for slidably contacting the liner of a single-faced corrugated paperboard sheet as the flute tips of the sheet pass over the rotating glue roll. Biasing means, such as compressed coil springs, are connected between the frame and the shoes for pressing the shoe contact surfaces in sliding contact with the liner of the single-faced sheet.

The shoes of the contact bar slidably contact the liner of the single-faced paperboard sheet, unlike the rotating pressure roll or air bearings of the prior art. Thus, the contact bar of the present invention is simple in construction and is easily maintained throughout its service life. The contact bar of the present invention, for example, includes no air passageways to clog with glue. At the same time, the contact bar greatly reduces the chance of crushing the flute tips of the single-faced paperboard sheet, unlike the prior art opposing pressure roll, since each of the shoes of the contact bar applies a predetermined pressure to the sheet over an arcuate portion of the rotating glue roll.

The contact surface of each of the shoes may be concave having an initial radius of curvature which approximates the curvature of the underlying glue roll. One aspect of the present invention is that the contact surfaces are formed of a material having a relatively long expected service life, for example two or more years, and yet which readily conforms to the single-faced sheet and rotating glue roll caused by abrasion from the sheet. A preferred material for the shoe contact surfaces is cold-rolled steel.

For most typical glue rolls having a radius of between 4.75 to 5.25 inches, the initial radius of curvature for the shoe contact surfaces may preferably be about 5.5 inches. During a typical break-in period of several days to a few weeks, the contact surfaces will conform to the rotating glue roll and single-faced sheet and any irregularities in the surface of the shoes will be removed by abrasion. Because the single-faced sheet is typically preheated to about 350° F. to activate the glue, the heat generated by sliding contact with the sheet has no significant effect.

The contact bar also includes clearance adjustment means for individually adjusting the clearance between each of the shoe contact surfaces and the outer surface of the rotating glue roll. The adjustment means may be a threaded bolt and nut extending between the frame and an end portion of the shoe opposite the compressed coil springs. The clearance is desirably set to less than the thickness of the single-faced corrugated paperboard sheet to be processed. For example, for a typical single-faced sheet thickness of about 0.105 inches for example, the clearance may be set to 0.045 inches. Thus, the single-faced paperboard sheet is pinched between the shoes and the glue roll to impart a pressure to the sheet to ensure proper contact of the flute tips with the glue roll without crushing the flute tips. Clearance is also maintained between the shoes and the rotating glue roll to prevent scratching or marring of the glue roll, such as during start-up of the machine when no single-faced sheet is between the shoes and the rotating glue roll.

The dimensions of the shoes of the contact bar and the biasing force, such as the spring force, are coordinated to provide a predetermined pressure to the single-faced sheet. For example, if the width of each shoe is increased, then the spring force must also be increased to yield the same pressure. The width of the shoes and the spring force are important when a single-faced sheet is processed which has its edges only partially underlying the outermost shoes. If too large of a width of shoe is used, all of the increased spring force is transferred to the sheet thereby crushing the flute tips at the edges of the sheet. Accordingly, the shoes of the present invention preferably have a contact surface area of about 3 and 9/16 of an inch in width, and 1 and ½ inches in length, with a spring force of about ½ pounds to prevent crushing of the flute tips, especially for a single-faced sheet only partially underlying the outermost shoes. Another aspect of the present invention provides that all of the shoes be of uniform dimensions to thereby reduce the inventory of spare parts required for maintaining the contact bar.

BRIEF DESCRIPTION OF THE DRAWINGS

FIG. 1 is a schematic view of corrugated paperboard manufacturing including a contact bar according to the present invention for pressing a single-faced sheet of corrugated paperboard against a rotating glue roll.

FIG. 2 is an enlarged cross-sectional view of the contact bar shown in FIG. 1.

FIG. 3 is a side elevational view of a spring retaining bolt for the contact bar as shown in FIG. 2.

DETAILED DESCRIPTION OF THE PREFERRED EMBODIMENTS

Figure 4:
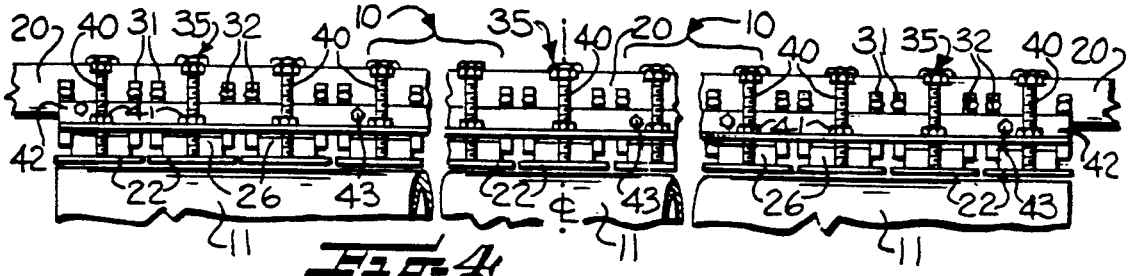
FIG. 4 is a front elevational view of the contact bar shown in FIG. 1 looking in the direction of arrow 4.
Figure 5:
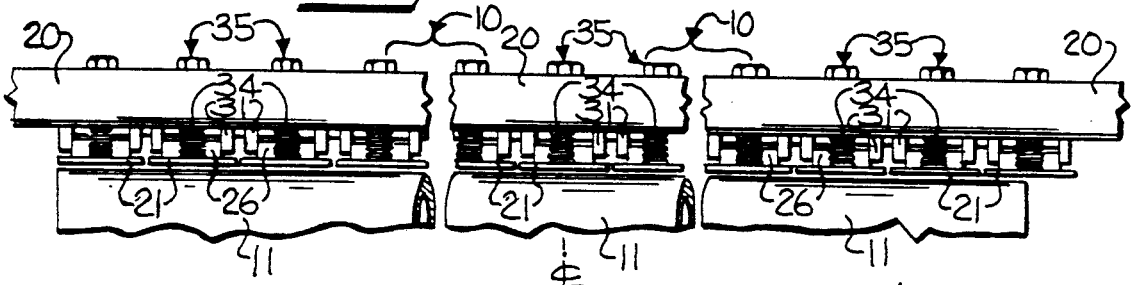
FIG. 5 is a rear elevational view of the contact bar shown in FIG. 1 looking in the direction of arrow 5.

The present invention will now be described more fully hereinafter with reference to the accompanying drawings, in which a preferred embodiment of the invention is shown. This invention may, however, be embodied in many different forms and should not be construed as limited to the embodiment set forth herein. Applicant provides this embodiment so that this disclosure will be thorough and complete, and will fully convey the scope of the invention to those skilled in the art. Like numbers refer to like elements throughout.

The contact bar according to the present invention is generally designated as 10 in the accompanying drawings. Referring to FIG. 1, there is shown schematically the contact bar 10 of the present invention cooperating with an opposing rotating glue roll 11 for applying glue 12, from a suitable reservoir 13 and glue metering device such as a scraper blade 19, to the flute tips 14 of a single-faced corrugated paperboard sheet 15. While a single scraper blade 19 is shown, it would be readily understood by those skilled in the art that an opposing metering roll and scraper blade, not shown, may also be used to meter glue 12 to the rotating glue roll 11. The second liner 16 is then positioned in contact with the glue bearing flute tips 14 of the single-faced sheet 15, typically by a roll 17 and an opposing pressure platen 18, thereby forming a double-faced corrugated paperboard sheet. After drying, the double-faced sheet forms a rigid structure, such as typically used in packaging and containers.

Referring to FIGS. 1–4, the contact bar 10 includes an elongate frame 20, such as formed of rectangular steel tubing. The frame 20 extends substantially across the entire Width of the rotating glue roll 11 in the illustrated embodiment. A series of side-by-side contact shoes 21 are pivotally connected to the frame 20 and depend therefrom. The contact shoes 21 are each preferably of uniform dimensions. For a standard glue roll 11, such as for manufacturing 87 inch width corrugated paperboard, the contact shoes 21 may be 25 in number with each shoe preferably being 3 and 9/16 inch in width as defined with respect to the axis of rotation of the glue roll 11. A slight gap is left between adjacent shoes 21. By having each contact shoe 21 of uniform dimensions, the inventory of required spare parts may be reduced.

Each of the contact shoes 21 includes a contact surface 22 for slidably contacting the liner side of the single-faced corrugated paperboard sheet 15. The contact surface 22 is preferably concave in shape approximating the curvature of the outer surface of the glue roll 11. The heat generated by friction between the shoe contact surfaces 22 and the single-faced corrugated paperboard sheet 15 presents no significant difficulties. In typical corrugated paperboard manufacturing machines, the glue 12 used is thermally responsive, that is, the glue must be at least about 145° F. to gel. Accordingly, the single-faced sheet 15 is typically preheated to about 350° F. before reaching the rotating glue roll 11. The environment of the contact bar 10 is, thus, typically about 250° F. The additional temperature rise caused by friction between the shoe contact surfaces 22 and the single-faced sheet 15 sliding thereagainst does not significantly affect the overall operating temperature of the single-faced paper 15 or the overall corrugating machine.

An aspect of the present invention is that minor irregularities in the shoe contact surfaces 22 are corrected during operation of the contact bar 10, particularly during an initial break-in period. A corrugated paperboard manufacturing machine may typically operate with the sheet 15 moving at a speed of 400–500 feet per minute. Some machines may operate at speeds of 1000 feet per minute. The single-faced sheet 15 slidably contacting the shoe contact surfaces 22 causes abrasion of the contact surfaces 22. Thus, any minor surface imperfections may be removed by the abrasion caused by the single-faced sheet 15. One possible cause for irregularities, or "hot spots", is less than perfect alignment of the shoes 21 with respect to the frame 20 as a result of manufacturing tolerances.

Typical glue rolls 11 have a diameter of between 9 and ½ to 10 and ½ inches. Accordingly the contact surface 22 of each shoe 21 may initially be formed having a radius of curvature of 5 and ½ inches. The slightly larger radius of curvature for the contact surface 22 than the glue roll 11 provides a lead-in and lead-out area for the single-faced sheet 15 adjacent the heel 23 and toe 24 portions respectively, as the contact surface 22 is being broken-in. The lead-in and lead-out areas reduce the potential for scraping of the single-faced sheet 15 against the heel 23 and toe 24 of the concave contact surface 22. As would be readily understood by those skilled in the art, a wrap roll, not shown, which guides the single-faced sheet to the glue roll 11, may be adjusted to ensure a correct angle of entry of the single-faced sheet 15 to the heel 23 of the shoe 21.

It has been found that cold-rolled steel is a preferred material for forming the contact surfaces 22 of the shoes 21. The abrasion resistance of cold-rolled steel provides a relatively quick break-in period of several days typically, yet also provides a relatively long expected service life of at least two years of normal operation. Thus, the radius of curvature for the shoe contact surfaces 22 is typically between 4 and ½ to 5 and ½ inches depending on the amount of break-in and the size of the rotating glue roll 11.

Each shoe 21 includes a mounting block 26 secured thereto on the upper side opposite the contact surface 22. The mounting block 26 is secured to the shoe 21 by one or more fasteners 27 which, as shown in the illustrated embodiment, lie substantially flush with the underside of the shoe 21. Each shoe 21 is pivotally secured to the frame 20 by positioning a pivot pin 30 through the mounting block 26 and a pair of spaced apart supports 31 depending from the frame 20. The depending supports 31 are secured to the frame 20 by fasteners 32.

Each shoe 21 is pivotally connected and includes biasing means cooperating therewith to urge the contact surface 22 in a direction away from the frame 20 and toward the single-faced sheet 15. The biasing means may be a compressed coil spring 34 as shown in the illustrated embodiment. The spring 34 is maintained in position between the shoe 21 and the frame 20 by a spring retaining bolt 35.

The spring retaining bolt 35, as best shown in FIGS. 2 and 3, includes a head 36, a smooth body portion 37, a threaded body portion 38, and a smooth end portion 39. The threaded portion 38 secures the retaining bolt 35 to the frame 20 with the smooth end portion 39 extending outwardly therefrom a predetermined distance to permit a range of pivotal movement of the shoe 21 without restriction caused by contact with the end portion 39 of the bolt. The outer radial end portion 39 of the bolt is smooth to permit compression of the coil spring 34 without restrictively engaging the coils thereof. As would be readily understood by those skilled in the art, other biasing means may be used to urge the shoe contact surfaces zz away from the frame 20 and against the single-faced corrugated paperboard sheet 15.

The pressure applied by the shoe contact surface 22 may be adjusted by providing a spring 34 with a desired spring force. As an example, for a shoe 21 having a contact surface 22 approximately 1 and ½ inches by 3 and 9/16 inches, the spring 34 preferably provides a force of about ½ pounds of force for a typical amount of deflection. Single-faced sheets typically include a predetermined number of flutes per length, and also have a predetermined thickness. For example, "A" fluting has about 3 flutes per inch and the fluting is about 0.185 inches thick. At the other end, "E" fluting has over 7 flutes per inch and has a thickness of about 0.045 inches. The contact bar 10 operates with all types of typical fluting to provide a correct backing pressure without crushing the flute tips.

Figure 6:
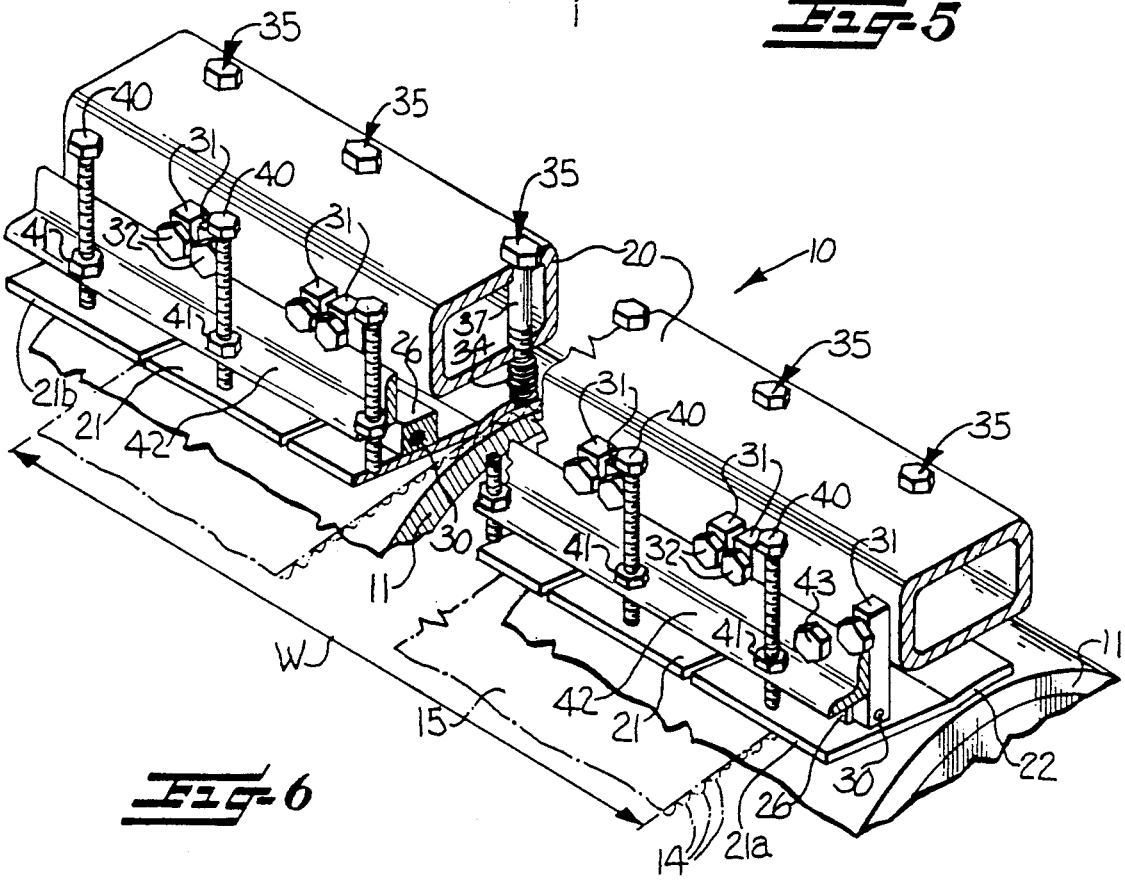
FIG. 6 is a fragmentary perspective view of the contact bar according to the present invention.

As shown in FIG. 6, a single-faced sheet 15, having a width W, may not extend fully under the corresponding outermost contact shoes 21*a*, 21*b* of the contact bar 10. The area of the shoe contact surface 22 and the force provided by the compressed spring 34, that is, the pressure exerted, must not crush the sheet 15 under these outermost shoes 21*a*, 21*b*. The preferred values given above for the contact surface 22 dimensions and the spring force, have been found to be suitable for processing a wide range of typical single-faced sheets 15, for example A through E fluting, without causing crushing at the edges of the Sheet 15. For a larger contact surface area, a stronger spring could be used to provide an equivalent pressure. However, a relatively wide shoe contact surface, not shown, and a large spring force is likely to crush the flute tips of the single-faced sheet 15 at its edges if the edges lie only partially under the outermost shoes. The entire force of the spring having the larger spring force would have to be distributed over a relatively small portion of the sheet 15 at its edges.

Referring to FIGS. 2 and 6, the contact bar 10 includes adjustment means to set a predetermined clearance between the surface of the glue roll 11 and the contact surface 22 for each of the shoes 21. The adjustment means includes an adjustment bolt 40 and nut 40 secured to an angle bracket 42 which in turn is secured to predetermined ones of the depending supports 31 by fasteners 43. The end of the adjustment bolt 40 bears against the upper surface of each shoe 21 at the end thereof opposite the compressed coil spring 34. Accordingly, the adjustment bolt 40 and nut 41 may be used to adjust the clearance between the contact surface 22 of the individual shoes 21 and the glue roll 11 after the frame 20 is roughly positioned opposite the glue roll 11. For a typical minimum thickness of a single-faced sheet 15 of about 0.105 inches, the clearance may preferably be set at about 0.045 inches. Thus, the passage of the single-faced sheet 15 between the glue roll 11 and the shoe contact surface 22 will cause deflection of the springs 34 thereby causing a backing pressure to be applied to the single-faced sheet 15 by the shoe contact surfaces 22. The clearance may be adjusted to accommodate slightly thinner or thicker single-faced sheets.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A method for applying glue to the flute tips of a single-faced corrugated paperboard sheet formed of a liner and a fluted medium, the method comprising:

passing the single-faced corrugated paperboard sheet over a rotating glue roll with the flute tips oriented facing the roll;

while slidably contacting the liner of the single-faced sheet at a predetermined pressure with a series of biased shoes collectively forming a contact bar and with each of the shoes positioned in a predetermined spaced relation to the glue roll to provide a clearance of less than the thickness of the single-faced corrugated paperboard sheet between each of the shoe contact surfaces and the outer surface of the rotating glue roll to ensure proper contact of the flute tips with the rotating glue roll without crushing the flute tips and to prevent scratching or marring of the glue roll, such as during start-up of the machine when no single-faced sheet is between the shoes and the rotating glue roll.

2. A method according to claim 1 including providing the shoe contact surfaces with an initial radius of curvature greater than the glue roll so as to accommodate various diameters of glue rolls.

3. A method according to claim 1 including selecting for the material of the shoes slidably contacting the liner of the single-faced sheet, a material having a relatively long expected service life and also having a predetermined abrasion resistance so that conformance of the shoe contact surfaces with the rotating glue roll and a single-faced sheet passing thereover occurs in a relatively short time.

4. A method according to claim 2 including selecting for the material of the shoes slidably contacting the liner of the single-faced sheet, a material having a relatively long expected service life and also having a predetermined abrasion resistance so that conformance of the shoe contact surfaces with the rotating glue roll and a single-faced sheet passing thereover occurs in a relatively short time.

* * * * *